US006400246B1

(12) United States Patent
Hill et al.

(10) Patent No.: US 6,400,246 B1
(45) Date of Patent: Jun. 4, 2002

(54) SWITCH WITH MAGNETICALLY COUPLED DUAL ARMATURE

(75) Inventors: Scott Allen Hill, Phoenix; Frank Freeman, Gilbert, both of AZ (US)

(73) Assignee: Duraswitch Industries, Inc., Mesa, AZ (US)

( * ) Notice: Subject to any disclaimer, the term of this patent is extended or adjusted under 35 U.S.C. 154(b) by 0 days.

(21) Appl. No.: 10/029,480

(22) Filed: Dec. 20, 2001

(51) Int. Cl.[7] ..... H01H 9/00
(52) U.S. Cl. ..... 335/205; 335/206; 200/512
(58) Field of Search ..... 335/205–208; 200/512, 520, 521

(56) References Cited

U.S. PATENT DOCUMENTS 3,681,723 A * 8/1972 Goll ..... 200/517
5,666,096 A * 9/1997 Van Zeeland ..... 333/104

* cited by examiner

*Primary Examiner*—Ramon M. Barrera
(74) *Attorney, Agent, or Firm*—Scott A. Hill

(57) ABSTRACT

An electrical switch, such as an automotive power window up/down switch, has an electrically conductive dual armature that is normally magnetically held in coupled engagement with a sheet magnet. The dual armature, a rectangular piece of metal, has first and second free ends. If a user applied force acts on the first free end of the dual armature, then the first free end breaks away from the sheet magnet and travels into first electrical contacts that are normally spaced from the dual armature, and the second free end functions as a fulcrum for the dual armature. Conversely, if a user applied force acts on the second free end, then the second free end breaks away from the sheet magnet and travels into second electrical contacts that are normally spaced from the dual armature, and the first free end functions as a fulcrum for the dual armature. Preferably, there is a physical barrier that prevents simultaneous actuation of the two switching functions.

20 Claims, 4 Drawing Sheets

SWITCH WITH MAGNETICALLY COUPLED DUAL ARMATURE

BACKGROUND OF THE INVENTION

Magnetic switches with magnetically coupled armatures provide a compact, reliable and durable switching function. These switches offer a very slim profile, low weight, economical assembly, and are used in an increasing number of applications in a variety of environments. They combine the tactile feel of a bulky mechanical switch with the compactness of a conventional flexible membrane switch. Magnetically coupled switches of this general type are shown and described in U.S. Pat. Nos. 5,523,730, 5,666,096, 5,990,772, 6,069,552 and 6,262,646 the disclosures of which are hereby incorporated herein by reference. While switches with magnetically coupled armatures already have many applications, it is advantageous to expand the applications of such switches even further, and the present invention relates to a magnetic switch, suitable for a large variety of applications, with a dual armature that is normally magnetically coupled to a sheet magnet coupler layer in an un-actuated position. The dual armature, a substantially rectangular and flat piece of metal, has first and second free ends (usually the shorter sides of the rectangle) that oppose each other. If a user applied force acts on the first free end of the dual armature, then the first free end breaks away from the coupler magnet and travels into first electrical contacts that are normally spaced from the dual armature, and the second free end functions as a fulcrum for the dual armature. Conversely, if a user applied force acts on the second free end, then the second free end breaks away from the coupler magnet and travels into second electrical contacts that are normally spaced from the dual armature, and the first free end functions as a fulcrum for the dual armature.

There are numerous uses and needs for magnetic pushbutton switches of the type shown in U.S. Pat. Nos. 5,523,730, 5,666,096, 5,990,772, and 6,262,646. These magnetic pushbutton switches are characteristically designed to be momentary switches that momentarily affect the logic of external electronics connected to the switches. Once the applied actuation force of a user is released from the pushbutton switch armature of such magnetic switches, the switch armature does not remain in the actuated position, but is returned to its initial position by the magnetic attraction of a coupler magnet. In being returned to its initial rest position, with the armature held by the coupler magnet, there is typically a return of the logic of the external electronics connected to the switch to its initial state.

Frequently, switch applications will require two momentary pushbutton switches, each actuating an opposing function on the same electrical device. Examples of such switch applications include power window up/down switches and power door lock/unlock switches on an automobile. A problem encountered when using two pushbutton switches for these devices, whether they be magnetic, membrane or mechanical, is that individual pushbutton switches can be operated simultaneously even though they power opposing functions that should not be actuated simultaneously. One solution is to use springs to hold a mechanical rocking device that physically prevents both switches from being actuated simultaneously. The dual armature of the present invention utilizes fewer parts, uses no springs, and, in a preferred embodiment, prevents simultaneous actuation of opposing switches. Furthermore, the dual armature switch of the present invention is compact, provides a crisp tactile feel, and may be sealed to prevent dirt and moisture from entering the switch.

SUMMARY OF THE INVENTION

The magnetically coupled dual armature switch of the present invention includes a unique dual armature made of an electrically conductive and magnetic material and a sheet magnet coupler layer that magnetically attracts and normally holds the dual armature in a rest position The magnetic attraction also provides resistance to actuation, giving the switch a tactile feel, and provides a return force that returns the dual armature to its rest position after an actuation force is removed. The rest position is where the dual armature is held in coupled engagement with the sheet magnet coupler layer. The dual armature may travel into and/or out of shorting relationship with electrical conductors of the switch. Electrical leads connect the electrical conductors of the switch to electronics that may be external to the switch. The electrical conductors are arranged within the switch so that the electrically conductive magnetic dual armature of the switch is movable into and out of shorting relationship with the electrical conductors to change the circuit logic for a circuit incorporating the switch. As used herein, the term "switch" includes devices for closing, opening, or changing the connections in an electrical circuit; the term "magnetic material" means a magnet or a material that is affected by a magnet; the term "electrical conductors" includes electrodes, resistive elements, electrical wires, and spaced electrical contacts or pads; and the term "top" refers to that surface of any part in a cross sectional figure of the drawings that faces the top edge of the page, while "bottom" refers to that surface that faces the bottom edge of the page.

The magnetic attraction between the sheet magnet coupler layer of the switch and the dual armature holds the top face of the dual armature in engagement with the bottom surface of the sheet magnet coupler layer. The dual armature of the magnetic dual switch of the present invention has at least two free ends that alternately function during switch actuation as either a fulcrum or to connect electrical contacts. An actuation force applied by a user to the top face of the dual armature substantially near one of the free ends of the dual armature causes the dual armature to pivot about the other free end that functions as a fulcrum. The top face of the dual armature breaks away from the sheet magnet coupler layer and travels into or out of electrical shorting relationship with electrical conductors of the switch. As the actuation force is applied by a user, the user feels a crisp, tactile snap as the top face of the dual armature breaks away from the sheet magnet coupler layer. When the actuation force exerted by the user is released, the dual armature is returned to and held in its rest position by the magnetic attraction of the sheet magnet coupler layer.

In a preferred embodiment of the magnetic dual switch of the present invention, the dual armature has a dual actuation barrier generally located substantially between the first and second free ends of the dual armature. In another preferred embodiment of the magnetic dual switch of the present invention, the edges that run perpendicular to the first and second free ends of the dual armature are third and fourth free ends that function as a second dual armature switch.

DETAILED DESCRIPTION OF THE INVENTION

Figure 1:
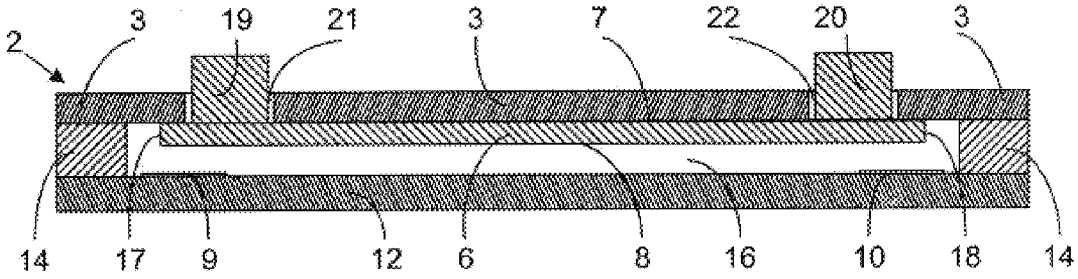
FIG. 1 is a cross sectional view taken horizontally at the midpoint, midway through the actuating buttons of a magnetic dual switch in its initial rest state.

FIG. 1 illustrates a magnetic dual switch of the present invention. The dual switch, shown generally at 2, includes a sheet magnet coupler layer 3 and a dual armature 6. The sheet magnet coupler layer shown in FIG. 1 is a rigid material, having very little flex when subjected to an anticipated force the switch might encounter, and has top and bottom surfaces 7 and 8. First and second sets of switch electrical conductors 9 and 10 are partially shown on a carrier layer 12. The carrier layer 12 is electrically nonconductive, e.g. a layer of printed circuit board material or plastic film such as polyester, and has the sets of switch electrical conductors formed, e.g. by screen printing or etching, on the top surface of the carrier layer. Electrical leads, not shown, connect the sets of switch electrical conductors 9 and 10 to electronics external to the switch 2. The carrier layer 12 is held spaced from the sheet magnet coupler layer 3 by a spacer layer 14. A typical spacer layer material would be closed cell adhesive foam, e.g. 3M Corporation VHB Series foam. The spacer layer is of substantially uniform thickness. The spacer layer is adhesively bonded or otherwise secured to the bottom surface of the sheet magnet coupler layer 3 and to the top surface of the carrier layer 12. There is an opening 16 in the spacer layer 14 that houses the dual armature 6. The dual armature is made of an electrically conductive and magnetic material such as, but not limited to, soft steel plated with silver.

In FIG. 1, the dual armature 6 is a rectangular piece of metal, having a substantially uniform thickness. For automotive type switches, an armature that is roughly 1 inch long by a half inch wide and has a thickness of about 20 to 30 thousandths of an inch is recommended when using steel, but these sizes and proportions are not at all necessary. Thicker armatures may be appropriate where switch abuse is anticipated, or where the armature will connect high current contacts. The parallel sides along the length of the rectangular dual armature 6 are edges. The parallel sides along the width of the rectangular dual armature 6 are first and second free ends 17 and 18. The free ends 17 and 18 of the dual armature 6 are engageable with the switch electrical conductors on the carrier layer 12. First and second actuating buttons 19 and 20 are fixed to the top face of the dual armature, protruding through first and second apertures 21 and 22 in the sheet magnet coupler layer 3.

Figure 2:
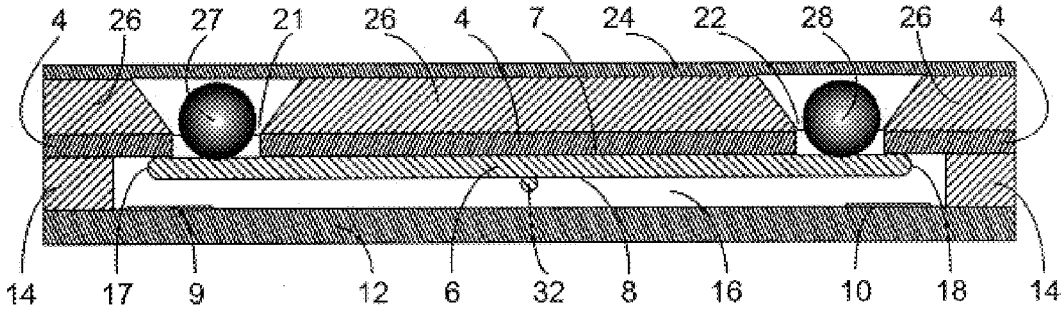
FIG. 2 is a cross sectional view of a magnetic dual switch in its initial rest state, having a metal dual armature, spheroid actuating buttons, overlay and dual actuation barrier according to the present invention. The view is taken along line 5—5 of FIG. 5, adding an overlay.
Figure 3:
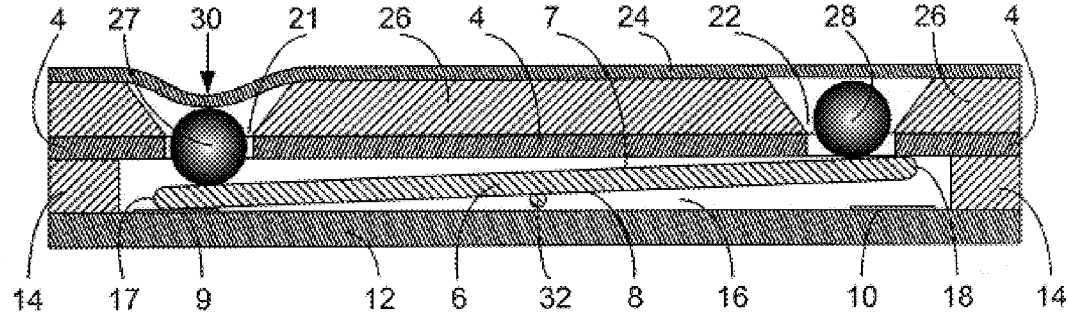
FIG. 3 is the view of FIG. 2 having the dual armature in its first actuated position.
Figure 4:
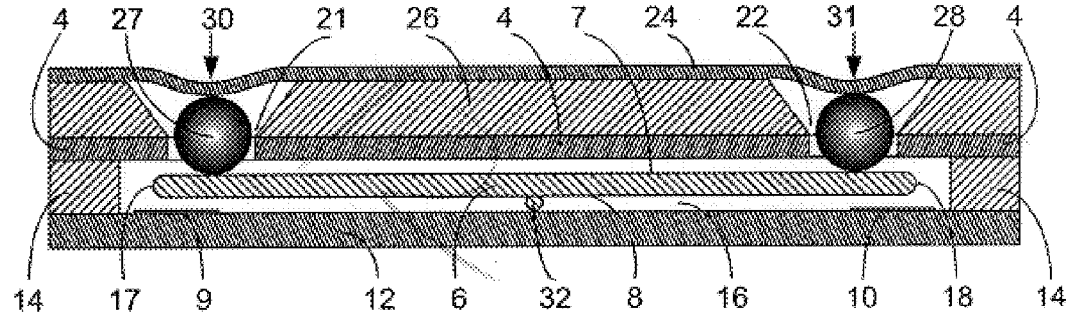
FIG. 4 is the view of FIG. 2 during an unsuccessful attempt to simultaneously connect the first and second actuation positions.

FIGS. 2 through 5 illustrate a preferred embodiment of the dual switch of the present invention and show how the switch fimctions. As shown in FIGS. 2 through 4, the switch is sealed by a flexible membrane layer 24. The flexible membrane layer is an overlay, e.g. a polyester film overlay, that overlays and seals the top of the switch. The flexible membrane layer is adhesively bonded or otherwise secured to the top of a rigid layer 26. The bottom of the rigid layer is fixed to the top surface of a sheet magnet coupler layer 4. Adhesive may be used to fix layers to each other. The rigid layer provides additional support to the sheet magnet coupler layer and allows for the use of flexible sheet magnet, which is relatively inexpensive and readily available. The apertures 21 and 22 extend through the rigid layer 26. The actuating buttons 27 and 28 are spheres with a diameter roughly equal to the distance from the top face of the dual armature 6 to the bottom surface of the flexible membrane layer 24. The apertures 21 and 22 are at least large enough so that the actuating buttons can move without binding during actuation. To improve the overall feel of a button to the user and to reduce wear on the flexible membrane overlay, the apertures expand toward the top of the switch, as shown.

FIG. 2 shows the dual switch in an un-actuated position, with the dual armature in its rest position. In this rest position, the top face of the dual armature is magnetically held on or adjacent the bottom surface of the sheet magnet coupler layer 4 and the free ends of the dual armature are held out of electrical contact with the electrical conductors of the switch. If an external force moves the dual armature to another position within the opening 16 that houses the dual armature, the magnetic attractive force of the sheet magnet coupler layer will return the dual armature to the rest position. Because the attractive force of a magnet drops off significantly with distance, the size of the opening should not be so large that the attractive force of the magnet cannot consistently return the dual armature to the rest position from any other position within the opening 16.

FIG. 3 shows the dual armature in a first actuated position. A first user-provided actuation force 30, when applied downwardly through the flexible membrane layer 24 to the first actuating button 27 such that the force is transferred to the top face of the dual armature near the first free end 17, causes the first free end 17 to break away from the bottom surface of the sheet magnet coupler layer 4 and causes the second free end 18 to function as a fulcrum for the dual armature so that the first free end 17 of the dual armature travels to make electrical contact with the first set of switch electrical conductors 9. An actuation force must be sufficient to overcome the magnetic attractive force coupling the dual armature to the bottom surface of the sheet magnet coupler layer 4. A tactile snap is felt as when the first free end 17 abruptly comes to rest on or adjacent the carrier layer 12. As soon as the actuation force is removed, the magnetic attraction between the sheet magnet coupler layer 4 and the dual armature 6 causes the dual armature to return to the normal rest position where it is once again held in place by being magnetically coupled to the sheet magnet coupler layer 4.

The actuating buttons should be centrally located between the edges of the armature for the dual armature to have a consistent tactile feedback. If one of the actuating buttons is located too closely to one of the edges, that edge may break away from the sheet magnet coupler layer instead of the intended free end breaking away and making contact with the set of electrical conductors. Additionally, an actuating button is considered to be on the top face of the dual armature near a free end if the actuating button is not so close to the free end that it might leave the top face of the dual armature, but the actuating button is not so far from the free end that upon actuation the other free end might fail to properly function as a fulcrum. For many applications, the actuating buttons will be centered on a distance from a free end that is between 5 and 30 percent of the length of the armature.

FIG. 4 shows the dual armature in an un-actuated position, but with two opposing user-provided actuation forces 30 and 31 being simultaneously applied through the flexible membrane layer 24 to the first and second actuating buttons 27 and 28. A dual actuation barrier 32 physically prevents the dual armature from simultaneously actuating more than one set of switch conductors at a time. The dual actuation barrier is, in its simplest form, the fulcrum of a teeter-totter. During normal actuation of the dual armature, as in FIG. 3, the dual actuation barrier 32 should not impede the travel of the dual armature to a set of switch electrical conductors when there is only one user-provided actuation force.

Figure 5:
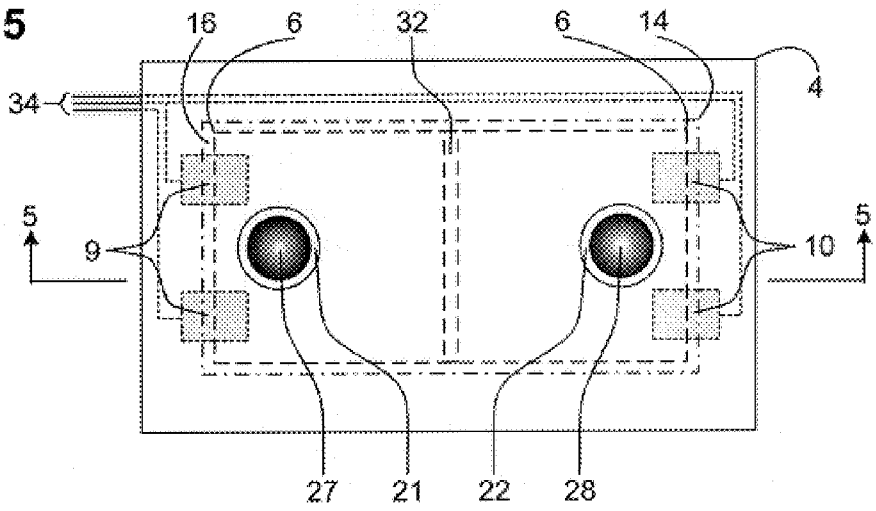
FIG. 5 is a plan view of the switch of FIG. 2 with the overlay removed.

FIG. 5 shows a plan view of the switch of FIGS. 2 through 4, except the overlay has been removed. FIG. 5 more clearly shows proper positioning of the actuating buttons substantially between the edges of the dual armature. The actuating button 27 or 28 should force the nearest free end of the armature into contact with the carrier layer so that the free end contacts the appropriate electrical contact pads at about the same time and with about the same amount of pressure. The electrical contact pads of FIG. 5 have been screen printed onto the carrier layer with appropriate leads 34 that connect to external electronics, not shown. The free ends of the dual armature are located substantially above the sets of switch electrical contacts 9 and 10. To prevent premature wear of the electrical contacts, the free ends may be deburred, rounded, or beveled to prevent sharp edges from cutting away electrical contact material.

Figure 6:
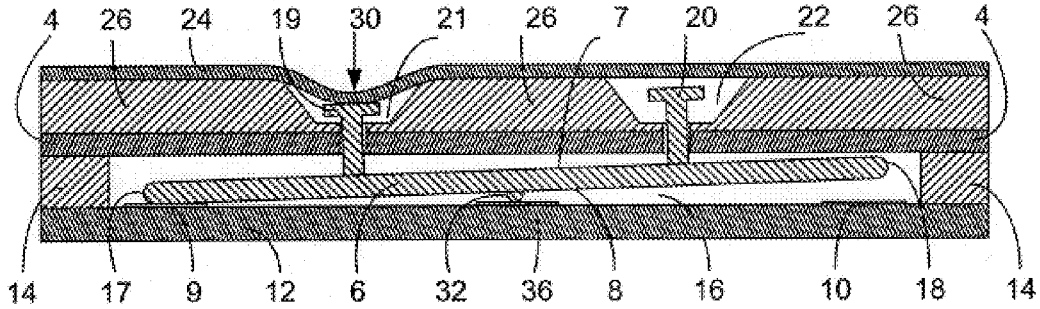
FIG. 6 is a cross sectional view taken horizontally at the midpoint, midway through the actuating buttons of a magnetic dual switch in its initial rest state.

FIG. 6 shows a dual armature with a dual actuation barrier 32 that also functions to electrically connect a common electrical conductor 36 shared by both sets of switch electrical conductors 9 and 10. In this embodiment, the actuating buttons are closer to the midpoint of the dual armature so sufficient actuation force is applied to the dual actuation barrier 32 to electrically connect the common electrical conductor 36 located on the carrier layer 12 beneath the dual actuation barrier. For this embodiment, it is acceptable for the dual actuation barrier to contact the carrier layer before the actuated free end electrically connects its switch electrical contact. Preferably, the position of the actuating button is such that the dual actuation barrier and the actuated free end of the armature will each receive about half of the user applied actuation force once electrical contact has been made.

FIG. 6 also shows a dual switch according to the present invention having actuating buttons that have a substantially flat top for receiving the actuation force. There is no particular advantage to using flat top buttons instead of spheres other than they affect the feel of the switch. The tactile feedback to the user is dispersed over a larger area of the flexible membrane when using a flat top button. The flat top button generally gives the switch a softer feel. The actuating buttons of FIG. 6 have a cylindrical core below the flat top. The cylindrical core travels through the part of the apertures 21 and 22 that pass through the sheet magnet coupler layer. Additionally, FIG. 6 shows the dual armature 6 with rounded free ends so the electrical contacts do not prematurely wear.

Figure 7:
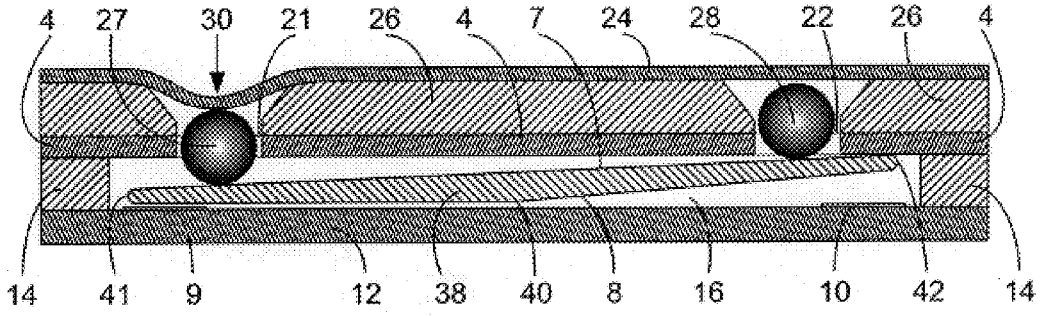
FIG. 7 is a cross sectional view, similar to that of FIG. 3, of a switch according to the present invention having a tapered dual armature.

FIG. 7 shows another dual armature that may be used in the magnetic dual switch of the present invention. Dual armature 38 is tapered in thickness from the dual actuation barrier 40 of the dual armature to free ends 41 and 42. The dual armature 38 is a solid piece of electrically conductive and magnetic material, and the top face 7 of the dual armature is substantially planar. The bottom of the dual armature 38 has two faces that extend at a fixed angle with respect to each other, with the fixed included angle between the bottom faces preferably being between about 182° and about 192°. The fixed included angle used should be enough so that the dual actuation barrier prevents simultaneous actuation of the switch electrical contacts 9 and 10, but the angle should not be so great as to interfere with normal actuation of the switch. Operation of the magnetic dual switch of FIG. 7 is substantially the same as the operation of the magnetic dual switch discussed above in FIGS. 2 through 5.

Figure 8:
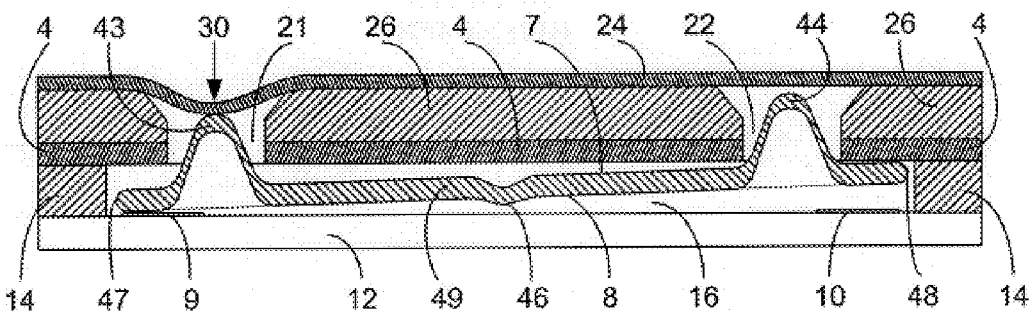
FIG. 8 is a cross sectional view of a switch having a formed dual armature. The cross sectional view of the armature is taken along line 45—45 of FIG. 9
Figure 9:
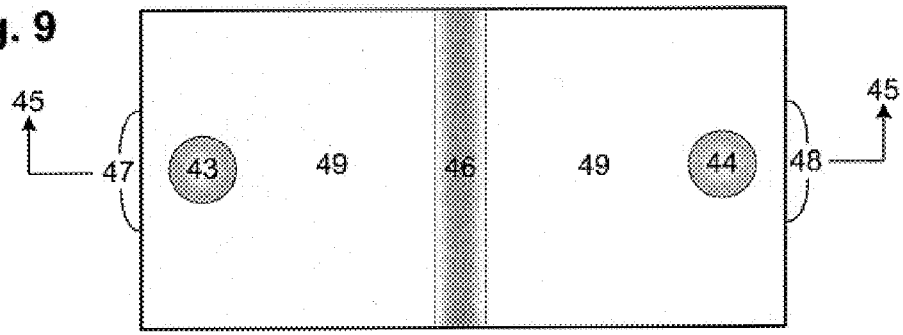
FIG. 9 is a plan view of the formed dual armature of FIG. 8.

FIGS. 8 and 9 show a dual switch according to the present invention having actuating buttons 43 and 44 and a dual actuation barrier 46 integrally formed into dual armature 49. A formed armature may be made by any appropriate process such as, but not limited to, stamping the armature into the desired shape. Formed actuating buttons on a dual armature provide many advantages that make this embodiment the most preferred and least expensive to manufacture and assemble. There are very few parts in a dual switch utilizing a formed armature. Assembly is greatly simplified where the armature self-aligns when magnetically coupled to the rest position because the formed buttons on the dual armature act as guides that center the actuating buttons in the apertures and, consequently, center the dual armature in the opening in the spacer layer. Resulting tolerances within the switch are improved because the switch armature is not able to float or slide about within the opening that houses the dual armature.

FIG. 8 is a cross sectional view of the dual switch having a formed armature. FIG. 9 is a plan view of the formed armature. The cross sectional view of the armature in FIG. 8 is taken along line 45—45 of FIG. 9. The dual actuation barrier, as shown, is a depending ridge 46 located substantially between the free ends 47 and 48 of the dual armature 49 and running the full width of the dual armature, from edge to edge. The formed dual actuation barrier functions in substantially the same way as the dual actuation barrier of FIGS. 2 through 4. Alternatively, the dual actuation barrier could be depending feet, similar to what will be described in the next embodiment of the invention.

Figure 10:
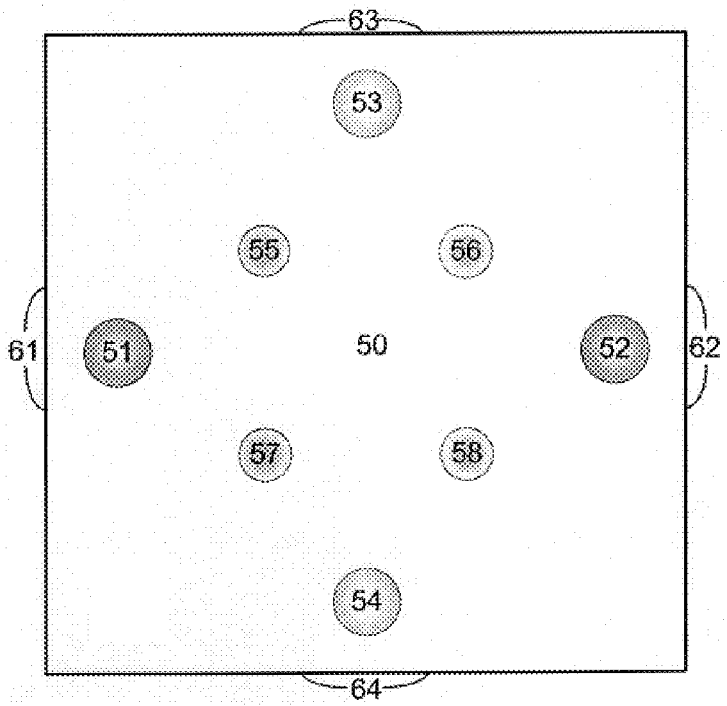
FIG. 10 is a plan view of a paired dual armature according to the present invention having third and fourth free ends.
Figure 11:
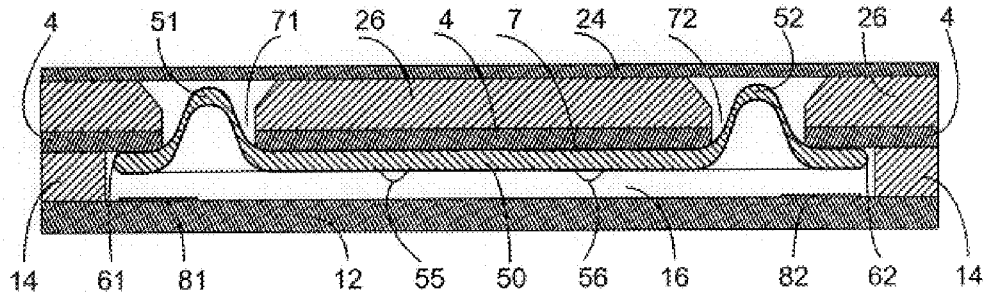
FIG. 11 is a cross sectional view, taken along line 60—60 of FIG. 12, of a switch according to the present invention utilizing the armature of FIG. 10.
Figure 12:
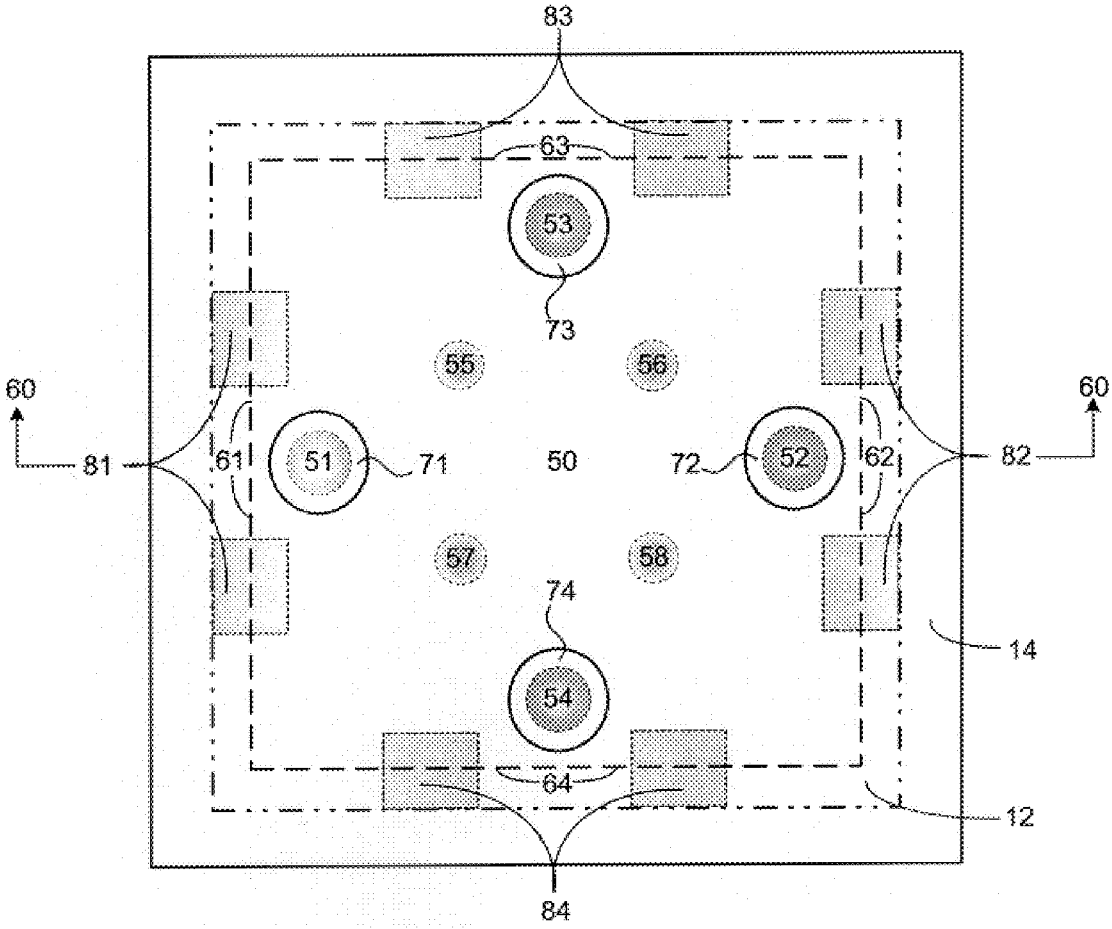
FIG. 12 is a plan view of the magnetic dual switch of FIG. 11.

For some applications, such as seat controls or power mirror adjustment switches in an automobile, it is desirable to have three or four switches all combined into one switch assembly. Although two dual armature switches according to the present invention may work for such applications, the cost and number of parts would increase unnecessarily. What have previously been referred to as the edges of a dual armature may function as third and fourth free ends. FIGS. 10 through 12 show a paired dual armature for a switch that has been modified to operate up to four separate switch functions on the same armature. Additionally, only one of the four operations may be actuated by the paired dual armature switch at any one moment in time. The third and fourth free ends of the paired dual armature function in substantially the same way as the first and second free ends of the dual armatures described above. While either the third or fourth free end of a paired dual armature is being actuated, the first and second free ends are edges and serve no particular purpose. Similarly, while the first or second free end of a paired dual armature is being actuated, the third and fourth free ends are just edges and serve no particular purpose.

FIG. 10 is a plan view of a paired dual armature 50 according to the present invention. The paired dual armature is very similar to the dual armature 49 of FIG. 9. First, second, third and fourth raised actuating buttons 51, 52, 53 and 54 have been formed into the paired dual armature 50. Depending feet 55, 56, 57 and 58 have also been formed into the paired dual armature. There are first, second, third and fourth free ends 61, 62, 63, and 64, that are the four edges of a square. The depending feet could, as an alternative, be ridges or a separate layer of material. The cross sectional view of the switch in FIG. 8 very nearly duplicates a cross sectional view at the midpoint of either a length or width of a switch incorporating the paired dual armature shown in FIG. 11. Maintaining the symmetry of any of the switches of the present invention is important because good symmetry results in consistent tactile feedback to a user as the user moves from one actuating button to another. Additionally, symmetrical dual armatures do not have to maintain any particular orientation to ensure proper alignment during assembly.

FIGS. 11 and 12 show a dual switch having a paired dual armature like the one shown in FIG. 10. The function of the switch is similar to that described in FIGS. 2 through 4. In the rest position, formed actuating buttons 51, 52, 53 and 54 protrude into apertures 71, 72, 73 and 74, respectively. If an actuation force is applied to the first actuating button 51, the first free end 61 breaks away from the bottom surface of the sheet magnet coupler layer, with the second free end 62 functioning as a fulcrum until the first free end 61 travels into electrical contact with switch electrical conductors 81 on the carrier layer, and the dual actuation barrier formed by depending feet 55 and 57 prevents actuation of any of the other sets of switch electrical conductors. If an actuation force is applied to the second actuating button 52, the second free end 62 breaks away from the bottom surface of the sheet magnet coupler layer, with the first free end 61 functioning as a fulcrum until the second free end 62 travels into electrical contact with switch electrical conductors 82 on the carrier layer, and the dual actuation barrier formed by depending feet 56 and 58 prevents actuation of any of the other sets of switch electrical conductors. If an actuation force is applied to the third actuating button 53, the third free end 63 breaks away from the bottom surface of the sheet magnet coupler layer, with the fourth free end 64 functioning as a fulcrum until the third free end 63 travels into electrical contact with switch electrical conductors 83 on the carrier layer, and the dual actuation barrier formed by depending feet 55 and 56 prevents actuation of any of the other sets of switch electrical conductors. If an actuation force is applied to the fourth actuating button 54, the fourth free end 64 breaks away from the bottom surface of the sheet magnet coupler layer, with the third free end 63 functioning as a fulcrum until the fourth free end 64 travels into electrical contact with switch electrical conductors 84 on the carrier layer, and the dual actuation barrier formed by depending feet 57 and 58 prevents actuation of any of the other sets of switch electrical conductors. The fourth set of switch electrical contacts and the fourth actuating button and aperture may be left off if only three switches are desired.

A dual switch of the present invention may be adapted for use as part of an Island switch panel. U.S. Pat. No. 6,262,646 shows and describes pushbutton Island switches and rotor Island switches that may be incorporated on the same switch panel as a dual armature Island switch of the present invention. The dual armature Island switch includes an actuator subassembly, a switch panel, and a flexible membrane overlay. The actuator subassembly is an individual module pre-assembled as a standalone part. The subassembly, from the top down, is a rigid layer adhesively bonded to a sheet magnet coupler layer, a dual armature, and a spacer layer. The subassembly closely resembles any of the switches described in FIGS. 2 through 12, except there is no carrier layer or flexible membrane overlay. An Island switch panel comprises: a panel layer, which is another spacer layer; panel sockets in the panel layer, which are openings that receive actuator subassemblies; and a panel substrate, which is a carrier layer that can accommodate multiple switches. A dual armature of an installed subassembly will, upon actuation by a user applied actuation force, electrically connect switch electrical conductors formed on the top surface of the panel substrate. The flexible membrane overlay covers all of the actuator subassemblies and the panel layer. The flexible membrane overlay, or film layer, is typically made of an elastomeric material. Suitable graphics may be printed on the flexible membrane overlay to instruct a user as to the location and function of an actuator subassembly.

While a preferred form of the invention has been shown and described, it will be realized that alterations and modifications may be made thereto without departing from the scope of the following claims. The sheet magnet coupler layers used in the various embodiments of the present invention may be made from molded magnetic materials. These molded sheet magnet coupler layers may include peripheral flanges that function as spacer layers. The dual armature could be made of any ferromagnetic material. High current applications are also anticipated, as would be the case if the switch electrical conductors directly connected wires to a motor. Finally, it will be understood that the term switch as used herein is intended to encompass devices of the type described whose electrical conductors are arranged either for on-off operation or for operation as a potentiometer, as in the case where pressure sensitive material is used for the electrical conductors.

What is claimed is:

1. An electrical switch, comprising:

a sheet magnet coupler layer having top and bottom surfaces;

a carrier layer having electrical contacts defining first and second sets of switch electrical conductors;

a spacer layer between the sheet magnet coupler layer and the carrier layer;

a dual armature, with top and bottom faces, made of an electrically conductive magnetic material; the dual armature being substantially rectangular, having two pairs of substantially parallel sides, and with the top face being substantially planar; one of the pairs of parallel sides defining first and second free ends; the top face of the dual armature being magnetically attracted to and normally held in coupled engagement with the bottom surface of the sheet magnet coupler layer so that the first and second free ends of the dual armature are spaced from the carrier layer;

an opening in the spacer layer that houses the dual armature;

first and second apertures through the sheet magnet coupler layer;

first and second actuating buttons that are substantially contained within the first and second apertures, respectively;

a first user-provided actuation force, when applied to the first actuating button such that the force is transferred to the top face of the dual armature near the first free end, causes the first free end to break away from the bottom surface of the sheet magnet coupler layer and causes the second free end to function as a fulcrum for the dual armature so that the first free end of the dual armature travels to make electrical contact with the first set of switch electrical conductors;

a second user-provided actuation force, when applied to the second actuating button such that the force is transferred to the top face of the dual armature near the second free end, causes the second free end to break away from the bottom surface of the sheet magnet coupler layer and causes the first free end to function as a fulcrum for the dual armature so that the second end of the dual armature travels to make electrical contact with the second set of switch electrical conductors; and upon release of the actuation force applied through the flexible membrane, the dual armature is returned to coupled engagement with the sheet magnet coupler layer by magnetic attraction between the dual armature and the sheet magnet coupler layer.

2. The electrical switch according to claim 1, wherein:

the actuating buttons are permanently fixed to the top face of the dual armature.

3. The electrical switch according to claim 1, further comprising:

a rigid layer with top and bottom surfaces, the bottom surface of the rigid layer being affixed to the top surface of the sheet magnet coupler layer; the first and second apertures further extending through the rigid layer; and a flexible membrane layer that overlays and is affixed to the top surface of the rigid layer.

4. The electrical switch according to claim 3, wherein:

the actuating buttons are spheres.

5. The electrical switch according to claim 2, wherein:

the actuating buttons are permanently fixed to the top face of the dual armature.

6. The electrical switch according to claim 5, wherein:

the rigid layer, sheet magnet coupler layer, spacer layer and dual armature form a subassembly that drops into a socket formed on a switch panel; the carrier layer and flexible membrane layer are shared with other subassemblies on the switch panel.

7. An electrical switch, comprising:

a carrier layer having electrical contacts defining first and second sets of switch electrical conductors;

a sheet magnet coupler layer having top and bottom surfaces;

a spacer layer between the sheet magnet coupler layer and the carrier layer;

a dual armature, with top and bottom faces, made of an electrically conductive magnetic material; the dual armature being substantially rectangular, having two pairs of substantially parallel sides, and with the top face being substantially planar; one of the pairs of parallel sides defining first and second free ends; the top face of the dual armature being magnetically returned to and normally magnetically held in coupled engagement with the bottom surface of the sheet magnet coupler layer so that the first and second free ends of the dual armature are spaced from the carrier layer;

an opening in the spacer layer that houses the dual armature;

a dual actuation barrier located between the carrier layer and the top face of the dual armature;

a rigid layer with top and bottom surfaces, the bottom surface of the rigid layer being affixed to the top surface of the sheet magnet coupler layer;

first and second apertures through the sheet magnet coupler layer and rigid layer;

first and second actuating buttons that are substantially contained within the first and second apertures, respectively;

a flexible membrane layer that overlays and is affixed to the top surface of the rigid layer;

a first user-provided actuation force, when applied through the flexible membrane to the first actuating button such that the force is transferred to the top face of the dual armature near the first free end, causes the first free end to break away from the bottom surface of the sheet magnet coupler layer and causes the second free end to function as a fulcrum for the dual armature so that the first free end of the dual armature travels to make electrical contact with the first set of switch electrical conductors, and a second user-provided actuation force, when applied through the flexible membrane to the second actuating button such that the force is transferred to the top face of the dual armature near the second free end, causes the second free end to break away from the bottom surface of the sheet magnet coupler layer and causes the first free end to function as a fulcrum for the dual armature so that the second end of the dual armature travels to make electrical contact with the second set of switch electrical conductors.

8. The electrical switch according to claim 7, wherein:

the dual armature's bottom face is tapered in thickness so there is a ridge that acts as the dual actuation barrier.

9. The electrical switch according to claim 7, further comprising:

at least one protrusion integrally formed on the bottom face of the dual armature, generally at the midpoint of the free ends, that acts as the dual actuation barrier; and the dual armature is a substantially uniform thickness.

10. The electrical switch according to claim 9, wherein:

the at least one protrusion electrically contacts a common electrical contact shared by the first and second sets of switch electrical conductors.

11. The electrical switch according to claim 7, wherein:

the dual armature is generally flat with a substantially uniform thickness and an additional thickness of a material fixed to the bottom face of the dual armature, with the material functioning as the dual actuation barrier.

12. The electrical switch according to claim 11, wherein:

the actuating buttons are spheres.

13. The electrical switch according to claim 7, wherein:

the dual actuation barrier is on the carrier layer.

14. The electrical switch according to claim 7, wherein:

the aperture is larger toward the top of the rigid layer.

15. The electrical switch according to claim 7, wherein:

the actuating buttons are permanently fixed to the top face of the dual armature.

16. An electrical switch, comprising:

a carrier layer having electrical contacts defining at least first, second and third sets of switch electrical conductors;

a sheet magnet coupler layer having top and bottom surfaces;

a spacer layer between the sheet magnet coupler layer and the carrier layer;

a dual armature, with top and bottom faces, made of an electrically conductive magnetic material; the dual armature being substantially rectangular, having two pairs of substantially parallel sides, and with the top face being substantially planar; one of the pairs of parallel sides defining first and second free ends and the other pair of parallel sides defining third and fourth free ends; the top face of the dual armature normally being magnetically held in coupled engagement with the bottom surface of the sheet magnet coupler layer so that the free ends of the dual armature are spaced from the carrier layer;

an opening in the spacer layer that houses the dual armature;

at least first, second and third apertures through the sheet magnet coupler layer;

at least first, second and third actuating buttons that are substantially contained within the at least first, second and third apertures, respectively;

a first user-provided actuation force, when applied to the first actuating button such that the force is transferred to the top face of the dual armature near the first free end, causes the first free end to break away from the bottom surface of the sheet magnet coupler layer and causes the second free end to function as a fulcrum for the dual armature so that the first free end of the dual armature travels to make electrical contact with the first set of switch electrical conductors, and a second user-provided actuation force, when applied to the second actuating button such that the force is transferred to the top face of the dual armature near the second free end, causes the second free end to break away from the bottom surface of the sheet magnet coupler layer and causes the first free end to function as a fulcrum for the dual armature so that the second free end of the dual armature travels to make electrical contact with the second set of switch electrical conductors, a third user-provided actuation force, when applied to the third actuating button such that the force is transferred to the top face of the dual armature near the third free end, causes the third free end to break away from the bottom surface of the sheet magnet coupler layer and causes the fourth free end to function as a fulcrum for the dual armature so that the third free end of the dual armature travels to make electrical contact with the third set of switch electrical conductors.

17. The electrical switch according to claim 16, further comprising:

a rigid layer with top and bottom surfaces, the bottom surface of the rigid layer being affixed to the top surface of the sheet magnet coupler layer.

18. The electrical switch according to claim 17, further comprising:

a flexible membrane layer that overlays and is affixed to the top surface of the rigid layer.

19. The electrical switch according to claim 16, further comprising:

a dual actuation barrier located between the carrier layer and the top face of the dual armature.

20. The electrical switch according to claim 16, further comprising:

a fourth set of switch electrical conductors on the carrier layer;

a fourth aperture through the sheet magnet coupler layer;

a fourth actuating button that is substantially contained within the fourth aperture;

a fourth user-provided actuation force, when applied to the fourth actuating button such that the force is transferred to the top face of the dual armature near the fourth free end, causes the fourth free end to break away from the bottom surface of the sheet magnet coupler layer and causes the third free end to function as a fulcrum for the dual armature so that the fourth free end of the dual armature travels to make electrical contact with the fourth set of switch electrical conductors.

* * * * *